US006518009B1

(12) United States Patent
Mydlarz et al.

(10) Patent No.: US 6,518,009 B1
(45) Date of Patent: Feb. 11, 2003

(54) HIGH INTENSITY EXPOSURE PHOTOGRAPHIC IMAGING METHOD EMPLOYING IRIDIUM DOPED HIGH CHLORIDE EMULSION

(75) Inventors: Jerzy Z. Mydlarz, Fairport, NY (US); Roger L. Klaus, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/608,841

(22) Filed: Jun. 30, 2000

(51) Int. Cl.[7] ..... G03C 1/005; G03C 1/08

(52) U.S. Cl. ..... 430/567; 430/569; 430/604; 430/605; 430/944; 430/945

(58) Field of Search ..... 430/567, 569, 430/604, 605, 944, 945

(56) References Cited

U.S. PATENT DOCUMENTS

| | | | | | |
|---|---|---|---|---|---|
| 5,126,235 | A | | 6/1992 | Hioki | |
| 5,284,745 | A | | 2/1994 | Ohshima | |
| 5,391,474 | A | * | 2/1995 | Haefner et al. | 430/569 |
| 5,474,888 | A | * | 12/1995 | Bell | 430/567 |
| 5,523,200 | A | * | 6/1996 | Hahm et al. | 430/569 |
| 5,547,827 | A | * | 8/1996 | Chen et al. | 430/567 |
| 5,550,013 | A | * | 8/1996 | Chen et al. | 430/567 |
| 5,627,020 | A | * | 5/1997 | Hahm et al. | 430/569 |
| 5,691,119 | A | | 11/1997 | Mydlarz et al. | |
| 5,750,324 | A | * | 5/1998 | Mydlarz et al. | 430/567 |
| 5,783,372 | A | * | 7/1998 | Budz et al. | 430/363 |
| 5,783,373 | A | | 7/1998 | Mydlarz et al. | |
| 5,783,378 | A | | 7/1998 | Mydlarz et al. | |
| 5,792,601 | A | * | 8/1998 | Edwards et al. | 430/567 |
| 5,830,631 | A | * | 11/1998 | Hendricks et al. | 430/543 |
| 5,948,601 | A | * | 9/1999 | Rieger | 430/383 |
| 6,107,018 | A | * | 8/2000 | Mydlarz et al. | 430/567 |

FOREIGN PATENT DOCUMENTS

| | | |
|---|---|---|
| EP | 479 167 B1 | 4/1992 |
| EP | 502 508 B1 | 9/1992 |

* cited by examiner

*Primary Examiner*—Janet Baxter
*Assistant Examiner*—Amanda C. Walke
(74) *Attorney, Agent, or Firm*—Andrew J. Anderson

(57) ABSTRACT

A method of imaging employing sensitized high chloride silver halide emulsions which exhibit improved speed and high intensity reciprocity performance for use with short duration, high intensity exposure optical and digital exposure systems. The method comprising providing a photographic element comprising at least one high chloride silver halide emulsion layer, exposing said element utilizing a high intensity actinic radiation exposure for an exposure time of less than 1/100 second, and developing said element to produce a photographic image, wherein the high chloride silver halide emulsion layer is comprised of silver halide emulsion grains containing at least 90 mole percent chloride, based on silver, obtained by providing a high chloride host emulsion, bringing a Lippmann emulsion comprising primarily fine silver bromide grains doped with iridium into contact with said high chloride host emulsion, and subsequently chemically sensitizing the high chloride emulsion.

16 Claims, No Drawings

HIGH INTENSITY EXPOSURE PHOTOGRAPHIC IMAGING METHOD EMPLOYING IRIDIUM DOPED HIGH CHLORIDE EMULSION

FIELD OF THE INVENTION

The invention relates to the sensitization of silver halide emulsion grains for use in a photographic element. The invention particularly relates to a process of finishing high chloride silver halide emulsions involving the incorporation of an iridium dopant before chemical sensitization, and the use of a photographic element comprising the finished emulsion in a high intensity exposure system.

BACKGROUND OF THE INVENTION

Many known photographic imaging systems require that a hard copy be provided upon relatively short exposure times (e.g., less than 1/100 of a second) from a high intensity exposing device, as with high speed optical printers or from electronic printing of an image which is in digital form. Optical printers include those such as described in, e.g., *Photofinishing Color Printing,* Edward Goll and Ellsworth McCune, 1990. Conventional optical exposure of photographic paper in a photofinishing apparatus, e.g., comprises the optical exposure of a photographic film negative onto photographic paper. In high volume photofinishing labs employing high speed optical printers, the images are provided at a high rate onto the photosensitive paper employing short exposure times in order to provide a low cost, high quality product. A typical example of digital imaging systems is electronic printing of photographic images which involves control of individual pixel exposure. Such a system provides greater flexibility and the opportunity for improved print quality in comparison to conventional optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration, high intensity exposure in a pixel-by-pixel mode using a suitable source such as a cathode ray tube (CRT), light emitting diode (LED) or laser. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, The Reproduction of Colour, Fourth Edition, pages 306–307, (1987).

In the formation of silver halide emulsions for use in photographic materials, a desirable characteristic is to have photographic materials that are capable of being rapidly processed. It is known that silver halide emulsions having high levels of chloride content (e.g., greater than 90 mole % chloride) are especially useful in achieving rapid processability due to their higher solubility compared to emulsions having greater than some minimum levels of other halides (for example, emulsions having greater than 10 mole % bromide or more than 3–5 mole % iodide or both).

Silver halide emulsions including those high in chloride content are also known to require some form of chemical sensitization in order to increase their photographic efficiency. Chemical sensitization of an emulsion involves the addition of one or more chemical sensitizing agents where the sensitizing agent is capable of undergoing a chemical reaction on the silver halide grain surface during the application of thermal energy for some time period. The chemical sensitization involving adding chemical sensitizer to an emulsion and heating is often referred to as chemical digestion of the silver halide emulsion. Emulsions, especially high chloride content emulsions, also require spectral sensitization involving the addition of surface adsorbing sensitizing dyes to the emulsion grains which make the grains sensitive to specific wavelengths of light. In addition, silver halide emulsion grains are often treated with other photographically useful chemical compounds such as salts of other halides which can cause surface conversion of the host emulsion grains to a mixed halide composition. Other known photographically useful compounds which can be added are antifoggants, stabilizers, metal dopants, silver halide solvents, ripeners, supersensitizers, coating aids and surfactants. The prior art generally discloses that these photographically useful compounds can be added prior to, during, or after the chemical sensitization or the spectral sensitization steps.

It is known that silver halide emulsions, including those high in chloride content, often exhibit substantial reciprocity law failure which can limit their usefulness. That is, these emulsions can exhibit a large change in photographic sensitivity and gradation due to a change in the illuminance of exposure. It has become increasing clear that with the continuing development of a variety of high intensity digital printing devices and high speed optical printers with short exposure times that photographic print materials with performance invariant to exposure time is increasingly important. When exposure times are reduced below one second to very short intervals (e.g., less than 1/100 second), higher exposure intensities must be employed to compensate for the reduced exposure times. High intensity reciprocity failure (hereinafter also referred to as HIRF) occurs when photographic performance is noted to depart from the reciprocity law when such shorter exposure times are employed. Print materials which traditionally suffer speed or contrast losses at short exposure times (high intensity exposures) will fail to reproduce detail with high resolution. Text will appear blurred. Through-put of digital print devices will suffer as well. Accordingly, print materials with reduced HIRF are desired in order to produce excellent photographic prints in a wide variety of digital and high speed optical printers.

It is known to incorporate certain metal dopant compounds into silver halide emulsion grains in order to improve reciprocity performance. It is further known that in order for the metal dopant to be effective in modifying silver halide emulsion performance such as reciprocity law failure, the metal dopant must be incorporated into the silver halide crystal which can be accomplished either during grain formation or during the sensitization process. It is also known that if the metal dopant is to be added after the emulsion grain formation as part of the finishing, it is often necessary to perform a surface halide conversion to cause the dopant to be incorporated. U.S. Pat. Nos. 5,284,745 and 5,391,474, e.g., disclose that high silver bromide content localized phases may be formed on high silver chloride content host emulsions by the use of fine grain silver bromide emulsions having iridium incorporated therein. Similarly, U.S. Pat. Nos. 5,523,200 and 5,627,020 disclose that iridium, as well as other materials, may be added by the use of silver bromide Lippmann emulsions. While certain improvements with respect to reciprocity performance have been reported in some of such references, there is a continuing need to further improve the high intensity reciprocity performance of chemically and spectrally sensitized high chloride silver halide emulsions, especially for use with high intensity exposure optical and digital exposure systems.

U.S. Pat. No. 5,284,745 specifically teaches that formation of high silver bromide content localized phases on high silver chloride content host emulsion grains prior to chemical sensitization results in emulsions which provide high sensitivity, good safelight aptitude and latent image stability wherein at least one of the high silver bromide phase formation or subsequent chemical sensitization is performed at relatively high pH of 6.5 or higher. While iridium may be incorporated in the high bromide phase formed prior to chemical sensitization, there is no specific teaching as to the effect of the iridium location on high intensity reciprocity failure. Additionally, while high pH during formation of the high silver bromide content phases may be beneficial with respect to sensitivity and latent image stability, it also may negatively contribute to fog growth on storage. All other specific prior art disclosures with respect to the addition of iridium doped fine silver bromide emulsion grains to high chloride host grains appear to add such iridium doped emulsions to high chloride host grains after chemical sensitization is performed.

SUMMARY OF THE INVENTION

It is an object of this invention to provide a method of imaging employing sensitized high chloride silver halide emulsions which exhibit improved speed and high intensity reciprocity performance for use with short duration, high intensity exposure optical and digital exposure systems.

The objects of the invention are generally accomplished by a method of imaging comprising providing a photographic element comprising at least one high chloride silver halide emulsion layer, exposing said element utilizing a high intensity actinic radiation exposure for an exposure time of less than 1/100 second, and developing said element to produce a photographic image, wherein the high chloride silver halide emulsion layer is comprised of silver halide emulsion grains containing at least 90 mole percent chloride, based on silver, obtained by providing a high chloride host emulsion, bringing a Lippmann emulsion comprising primarily fine silver bromide grains doped with iridium into contact with said high chloride host emulsion, and subsequently chemically sensitizing the high chloride emulsion.

ADVANTAGEOUS EFFECT OF THE INVENTION

The method of the invention employs silver halide emulsions having improved speed and high intensity reciprocity performance. Iridium addition to the silver halide emulsions used in accordance with the invention has numerous advantages over prior techniques of adding iridium to silver halide grains. By means of the instant technique, it is possible to more effectively utilize the iridium to achieve the increased reciprocity performance of the grains used in accordance with the invention. The invention accordingly also allows the use of less iridium in order to achieve the same effect as previously required. The invention also allows use of less bromide, thereby improving keeping and improving contrast. These and other advantages will become apparent from the description below.

DETAILED DESCRIPTION OF THE INVENTION

The high chloride silver halide emulsions employed in the method of this invention can be precipitated by any of the methods known in the art, for example, those described in T. H. James, *The Theory of the Photographic Process* (4th Ed.), *Research Disclosure* 36544 of September 1994 in Sections I–III, or *Research Disclosure* 37038 of February 1995 in Section XV. The silver halide emulsions should be high in chloride content meaning at least about 90 mole % chloride, preferably at least about 95 mole % chloride and most preferably at least 97 mole % chloride for rapid processing and good image formation. Some bromide may be incorporated during a late stage of precipitation, but the most preferred method of bromide incorporation is addition after the formation of silver chloride grains by a surface conversion process. The emulsion should also contain less than 5 mole % iodide, preferably less that 2 mole %, and most preferably less than 1 mole % iodide. The source of either the added bromide or iodide may be any of the commonly known salts, complexes, or compounds which can suitably release the halide, including silver bromide or silver iodide grains.

In a widely used form high chloride grains are precipitated to form cubic grains—that is, grains having {100} major faces and edges of equal length. In practice ripening effects usually round the edges and corners of the grains to some extent. However, except under extreme ripening conditions substantially more than 50 percent of total grain surface area is typically accounted for by {100} crystal faces.

High chloride tetradecahedral grains are a common variant of cubic grains and are also within the contemplation of this invention. These grains contain 6 {100} crystal faces and 8 {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another contemplated form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. Nos. 5,264,337 and 5,292,632, House et al U.S. Pat. No. 5,320,938, Brust et al U.S. Pat. No. 5,314,798 and Chang et al U.S. Pat. No. 5,413,904, the disclosures of which are here incorporated by reference.

Emulsion precipitation may be conducted in the presence of any of the commonly known dispersing media including gelatin, synthetic polymers or peptizers, and conditions of precipitation may include any specific means to avoid fog such as control of pAg and pH. Use of a gelatino-peptizer that contains less than 30 micromoles of methionine per gram, while not required, is specifically contemplated.

Furthermore, other chemical agents may also be present during the silver halide emulsion precipitation such as oxidizing agents, antifoggants, sensitizing dyes or other photographically useful compounds as described in *Research Disclosure* 37038 of February 1995 in Section XV. It is specifically contemplated to use thiosulfonate compounds alone or in combination with sulfinates or selinates during the preparation or treatment of these emulsions.

It is also contemplated to use one or more of the known useful metal dopants during precipitation of the high chloride content silver halides in order to modify the emulsion performance as known in the art, as described, e.g., in the following discussed references. Metal dopants include salts or coordination complexes, especially hexacoordination complexes with ligands such as halo, aquo, cyano, cyanato, thiocyanoto, nitrosyl, oxo, and carbonyl ligands or combinations thereof. Suitable metal dopants are salts or coordination complexes of Group VIII metals (e.g., iron, ruthenium, rhodium, palladium, osmium, iridium and platinum). The most preferred dopants are salts or complexes of the metals Ir, Os, Ru and Fe. Specific example of these dopants are described in *Research Disclosure* 37038 of February 1995 in Section XV, Part B. The use of dopants in silver halide grains to modify photographic performance is also generally illustrated by *Research Disclosure,* Item 38957, sections I. Emulsion grains and their preparation, and D. Grain modifying conditions and adjustments, paragraphs (3)–(5). McDugal et al U.S. Pat. No. 4,933,272 was the first to teach the incorporation of hexacoordination complexes containing a transition metal and a nitrosyl or thionitrosyl ligand as adopant in silver halide grains. Keevert et al U.S. Pat. No. 4,945,035 was the first to teach the incorporation of a hexacoordination complex containing a transition metal and cyano ligands as a dopant in high chloride grains. Bell U.S. Pat. Nos. 5,252,451, 5,256,530, 5,385,817, 5,474,888, 5,480,771 and 5,500,335, investigated the effects of varied combinations of grain dopants and surface modifiers. Edwards et al U.S. Pat. No. 5,418,118 teaches color paper constructions in which instantaneous contrast progressively increases in going from areas of minimum density to areas of maximum density, so that increased detail in shadow areas can be seen. McIntyre et al U.S. Pat. No. 5,597,686 discloses employing Os(NO) and M(CN) dopants in combination to improve contrast. Mydlarz et al U.S. Pat. Nos. 5,783,373 and 5,783,378 disclose high chloride emulsions, and a method for the electronic printing of a recording element comprising a silver halide emulsion layer comprised of such high chloride emulsions, internally containing three dopants each selected to satisfy a different one of the following class requirements: (i) a metal coordination complex containing a nitrosyl or thionitrosyl ligand in combination with a transition metal chosen from groups 5 to 10 inclusive of the periodic table of elements, (ii) a shallow electron trapping dopant, and (iii) an iridium coordination complex having ligands each of which are more electropositive than a cyano ligand.

Once high chloride host grains have been precipitated (and after an optional emulsion washing step as described, e.g., in *Research Disclosure,* Item 38957, III. Emulsion washing), the invention incorporates iridium dopants by means of surface conversion of the host high chloride emulsion grains with a doped fine grain primarily silver bromide emulsion. In the invention it is also possible to employ a mixture of fine grain (Lippmann) silver halide emulsions, doped and undoped in order to independently control the extent of the halide conversion of the host grain as well as controlling the dopant level. This allows change of the ratio of bromide and iridium, without change in the composition of the iridium dopant containing Lippmann bromide.

The invention preferably utilizes Lippmann bromide fine grain emulsions of a grain size of 0.02 microns to about 0.08 microns in the average linear dimension. These grains are doped with iridium for control of reciprocity failure in the high chloride grains. The iridium is generally added to the Lippmann emulsions as a ligand such as halo, aquo, cyano, cyanate, thiocyanate, nitrosyl, oxo, and carbonyl ligands, or combinations thereof. The iridium materials added are generally provided in an amount of between 0.001 milligrams per silver mole and 5.0 milligrams per silver mole, more preferably between 0.005 and 3.5 milligrams per silver mole, based on total silver. In accordance with the invention, the bromide generally is added to the host emulsion in an amount between about 0.05 and 3.0 mole percent bromide, based on total silver.

The iridium doped Lippmann bromide may be added to the high chloride grains at any temperature that achieves the desired placement of the iridium and bromide on the grain. Typically, such temperatures are between about 40 and 80° C. pH is preferably maintained at below 6.5 during addition of the iridium doped Lippmann bromide emulsion grains, as good high intensity exposure reciprocity performance, as well as good high intensity digital exposure sensitivity and contrast performance has been found to be obtained while avoiding the disadvantage of increased fog growth associated with higher pH levels. In accordance with the invention, the iridium doped Lippmann bromide emulsion grains are added prior to chemical sensitization of the high chloride emulsion grains.

Once high chloride grains have been precipitated and treated with iridium doped Lippmann bromide emulsions, subsequent chemical and spectral sensitization, followed by the addition of conventional addenda to adopt the emulsion for the imaging application of choice, can take any convenient conventional form. These conventional features are illustrated by *Research Disclosure,* Item 38957, particularly:

IV. Chemical sensitization;

V. Spectral sensitization and desensitization;

VII. Antifoggants and stabilizers;

VIII. Absorbing and scattering materials;

IX. Coating and physical property modifying addenda; and

X. Dye image formers and modifiers.

The sensitization of silver halide emulsions, especially the high chloride content emulsions employed in this invention, involves subjecting the silver halide grains to a heat treatment step during which any common photographically useful compound might be present. Alternatively, the emulsion may be subjected to a double heat treatment, wherein the first heat treatment is the chemical sensitization (digestion) step and the second heat treatment is a step performed in the presence of other chemical compounds known to be photographically useful. It is contemplated that the thermal history of the silver halide emulsion during any of the heat treatment steps will be chosen in such a way that the treatment temperature and time will give an optimum final emulsion performance. The temperature and time will depend on the choice and level of the chemical compounds that are present in the emulsion before, or during the heat treatment steps. The temperature of the heat treatment steps should be greater than that required to simply melt the silver halide emulsion and gelatin mixture, typically above 45° C., but usually less than about 80° C. The upper temperature of about 80° C. is determined by the rapid rate of chemical reactions at higher temperature, by thermal degradation of the gelatin, or by excessive evaporation, although evaporation may be minimized by covering the reaction vessel during heating. A finishing temperature between 50 and 65° C. has been found to be most suitable.

The chemical sensitization (digestion) can be accomplished by any of a variety of known chemical sensitizing agents such as those described in *Research Disclosure* 37038 of February 1995 in Section XV. The preferred sensitizing agents would be sulfiding agents, sources of gold, combinations of sulfur and gold, or aqueous colloidal gold sulfide because of the ability these agents have to produce substantially higher emulsion speed/sensitivity as compared to untreated emulsions.

In the simplest contemplated form a recording element contemplated for use in the imaging method of the invention can consist of a single emulsion layer satisfying the emulsion description provided above coated on a conventional photographic support, such as those described in *Research Disclosure,* Item 38957, cited above, XVI. Supports. In one preferred form the support is a white reflective support, such as photographic paper support or a film support that contains or bears a coating of a reflective pigrnent. To permit a print image to be viewed using an illuminant placed behind the support, it is preferred to employ a white translucent support, such as a Duratrans™ or Duraclear™ support.

The method of the invention can be used to form either silver or dye images in the recording element. In a simple form a single radiation sensitive emulsion layer unit is coated on the support. The emulsion layer unit can contain one or more high chloride silver halide emulsions satisfying the requirements of the invention, either blended or located in separate layers. When a dye imaging forming compound, such as a dye-forming coupler, is present in the layer unit, it can be present in an emulsion layer or in a layer coated in contact with the emulsion layer. With a single emulsion layer unit a monochromatic image is obtained.

In a preferred embodiment the invention employs recording elements which are constructed to contain at least three silver halide emulsion layer units. A suitable multicolor, multilayer format for a recording element used in the invention is represented by the following Structure:

| |
|---|
| Red-sensitized<br>cyan dye image-forming silver halide emulsion unit |
| Interlayer |
| Green-sensitized<br>magenta dye image-forming silver halide emulsion unit |
| Interlayer |
| Blue-sensitized<br>yellow dye image-forming silver halide emulsion unit |
| ///// Support ///// |

wherein the blue-sensitized, yellow dye image-forming unit is situated nearest the support; next in order is the green-sensitized, magenta dye image-forming unit, followed by the uppermost red-sensitized, cyan dye image-forming silver halide emulsion unit. The image-forming units are separated from each other by hydrophilic colloid interlayers containing an oxidized developing agent scavenger to prevent color contamination. Silver halide emulsions satisfying the requirements described above can be present in any one or combination of the emulsion layer units. Additional useful multicolor, multilayer formats for an element of the invention include Structures I, II, and IV–VI as described in U.S. Pat. No. 5,783,373, which is incorporated by reference herein. Each of such structures for use in accordance with the invention would contain at least one silver halide emulsion comprised of high chloride grains satisfying the requirements described above. Preferably each of the emulsion layer units contain an emulsion satisfying these criteria.

Conventional features that can be incorporated into multilayer (and particularly multicolor) recording elements contemplated for use in the method of the invention are illustrated by *Research Disclosure,* Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

In accordance with the invention, recording elements comprising radiation sensitive high chloride emulsion layers as described above are exposed utilizing a high intensity actinic radiation exposure for an exposure time of less than 1/100 second, preferably less than or equal to 1/1000 second. Such exposures may be made by a high speed optical printer, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in U.S. Pat. No. 4,619,892, incorporated herein by reference. Suitable exposures include those up to 2000 nm, preferably up to 1500 nm. The exposing source need, of course, provide radiation in only one spectral region if the recording element is a monochrome element sensitive to only that region (color) of the electromagnetic spectrum. Suitable light emitting diodes and commercially available laser sources are described in the examples. Imagewise exposures at ambient, elevated or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18 and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and sometimes from $10^{-3}$ ergs/cm$^2$ to $10^{-2}$ ergs/cm$^2$. Exposure of the recording element in a pixel-by-pixel mode as known in the prior art persists for only a very short duration or time. Typical maximum pixel-by-pixel exposure times are up to 100$\mu$ seconds, often up to 10$\mu$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer,* Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1, the disclosures of which are hereby incorporated herein by reference.

Once imagewise exposed, the recording elements can be processed in any convenient conventional manner to obtain a viewable image. Such processing is illustrated by *Research Disclosure,* Item 38957, cited above:

XVIII. Chemical development systems

XIX. Development

XX. Desilvering, washing, rinsing and stabilizing

Typically, processing to form a visible dye image includes the step of contacting the recording element with a color developing agent to reduce developable silver halide and oxidize the color developing agent. Oxidized color developing agent in turn reacts with the coupler to yield a dye. Preferred color developing agents are p-phenylenediamines. Especially preferred are 4-amino-3-methyl-N,N-diethylaniline hydrochloride, 4-amino-3-methyl-N-ethyl-N-(methanesulfonamido)ethylaniline sulfate hydrate, 4-amino-3-methyl-N-ethyl-N-hydroxyethylaniline sulfate, 4-amino-3-(methanesulfonamido)ethyl-N,N-diethylaniline hydrochloride, and 4-amino-N-ethyl-N-(2-methoxyethyl)m-toluidine di-p-toluenesulfonic acid.

With negative-working silver halide, the processing step described hereinbefore provides a negative image. The described elements can be processed in the color paper process Kodak Ektacolor RA-4 or Kodak Flexicolor color process as described in, for example, the British Journal of Photography Annual of 1988, pages 196–198. To provide a positive (or reversal) image, the color development step can be preceded by development with a non-chromogenic developing agent to develop exposed silver halide but not form dye, and then uniform fogging of the element to render unexposed silver halide developable. The Kodak E-6 Process is a typical reversal process. Development is followed by the conventional steps of bleaching, fixing, or bleach-fixing, to remove silver or silver halide, washing, and drying.

The described elements can be also processed in the ionic separation imaging systems which utilize the sulfonamidonaphtol diffusion transfer technology. Such a photographic product comprises at least one image dye providing element comprising at least one layer of photosensitive silver halide emulsion with which is associated a non-diffusible image dye-providing substance. After image-wise exposure, a coating is treated with an alkaline processing composition in the presence of a silver halide developing agent in such a way that for each dye image forming element, a silver image is developed. An image-wise distribution of oxidized developer cross-oxidizes the molecule of the image dye-providing compound. This, in an alkaline medium, cleaves to liberate a diffusible image dye. A preferred system of this type is disclosed in published in Fleckenstein U.S. trial voluntary protest document B351, 637, dated Jan. 28, 1975. Other patents include: U.S. Pat. Nos. 4,450,224 and 4,463,080, and U.K. Patents 2,026,710 and 2,038,041.

In a similar technology, a silver halide photographic process is combined with LED exposure and thermal development/transfer resulting in a high image quality hard copy system incorporating digital exposure technology. This is disclosed in many patents including U.S. Pat. Nos. 4,904,573; 4,952,969; 4,732,846; 4,775,613; 4,439,513; 4,473,631; 4,603,103; 4,500,626; 4,713,319 (Fujix Pictography).

This invention can be better appreciated by reference to the following examples. Such examples, however, are not intended to be exhaustive of all possible variations of the invention. Emulsions A through C illustrate the preparation of radiation sensitive high chloride emulsions, both for comparison and inventive applications. Examples 1 through 5 illustrate that recording elements containing layers of emulsions in accordance with inventive applications exhibit characteristics which make them particularly useful in very fast optical printers and in electronic printing methods of the type described herein. The term "regular gelatin" is used to indicate gelatin that was not treated to reduce its methionine content and that had a naturally occurring methionine content of about 50 micrograms per gram.

Emulsion Precipitations

Emulsion A

A reaction vessel contained 6.92 L of a solution that was 3.8% in regular gelatin and contained 1.71 g of a Pluronic antifoam agent. To this stirred solution at 46° C. 83.5 mL of 3.0 M NaCl was dumped, and soon after 28.3 mL of dithiaoctanediol solution was poured into the reactor. A half minute after addition of dithiaoctanediol solution, 104.5 mL of a 2.8 M $AgNO_3$ solution and 107.5 mL of 3.0 M NaCl were added simultaneously at 209 mL/min for 0.5 minute. The vAg set point was chosen equal to that observed in the reactor at this time. Then the 2.8 M silver nitrate solution and the 3.0 M sodium chloride solution were added simultaneously with a constant flow at 209 mL/min over 20.75 minutes. The resulting silver chloride emulsion had a cubic shape that was 0.38 $\mu$m in edgelength. The emulsion was then washed using an ultrafiltration unit, and its final pH and pCl were adjusted to 5.6 and 1.8, respectively.

Emulsion B

A silver halide emulsion was precipitated by equimolar addition of silver nitrate and sodium chloride solution into a well-stirred reactor containing gelatin peptizer and thioether ripener. Silver nitrate solution contained 0.08 mg mercuric chloride based on silver. After 93 mole percent of total silver was precipitated 200 mL of solution containing potassium iodide in an amount corresponding to 0.3 mole percent of total silver precipitated was dumped to the reactor. Total precipitation time of 32 minutes yielded cubic shaped silver iodochloride (0.3 mole % iodide) grains of 0.68 $\mu$m in edgelength size. The emulsion was then washed using an ultrafiltration unit, and its final pH and pCl were adjusted to 5.6 and 1.8, respectively.

Emulsion C

A pure chloride silver halide emulsion was precipitated by equimolar addition of silver nitrate and sodium chloride solution into a well-stirred reactor containing gelatin peptizer and thioether ripener. To this stirred solution at 46.1° C. 64.5 mL of 3.0 M NaCl was dumped, and soon after 25.9 mL of dithiaoctanediol solution was poured into the reactor. A half minute after addition of dithiaoctanediol solution, 133.1 mL of a 2.8 M $AgNO_3$ solution and 130 mL of 3.0 M NaCl were added simultaneously at 177.4 mL/min for 0.75 minute. The vAg set point was chosen equal to that observed in the reactor at this time. Then the 2.8 M silver nitrate solution and the 3.0 M sodium chloride solution were added simultaneously with a constant flow at 177.4 mL/min over 22.27 minutes. The resulting silver chloride emulsion had a cubic shape that was 0.28 $\mu$m in edgelength. The emulsion was then washed using an ultrafiltration unit, and its final pH and pCl were adjusted to 5.6 and 1.8, respectively.

Sensitization of Emulsions

The emulsions were each optimally sensitized by the customary techniques using three basic sensitization schemes. The sequence of chemical sensitizers, spectral sensitizers, and antifoggants addition are the same for each finished emulsion, however, position of iridium in the finish varied depending on the particular emulsion being sensitized. Both colloidal gold sulfide and gold(I) (as disclosed in U.S. Pat. No. 5,945,270) and hypo were used for chemical sensitization. Before sensitizations, pH was adjusted to 4.3 for red-sensitized emulsions, 5.7 for green-sensitized emulsions, and 4.55 for blue sensitized emulsions. Further detailed procedures are described in the Examples below. Lippmann bromide emulsion employed in all instances was of approximately 0.05 micrometer grain size. Iridium doped Lippmann bromide emulsions were prepared similarly as described in U.S. Pat. No. 5,627,020 Emulsion D.

In red-sensitized emulsions the following Spectral Sensitizing Dye A was used:

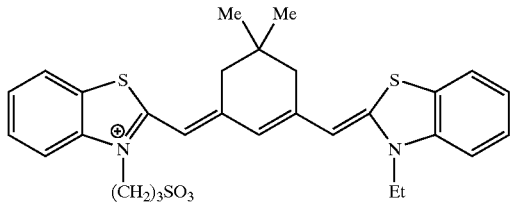

Just prior to coating on resin coated paper support red-sensitized emulsions were dual-mixed with cyan dye forming Coupler A:

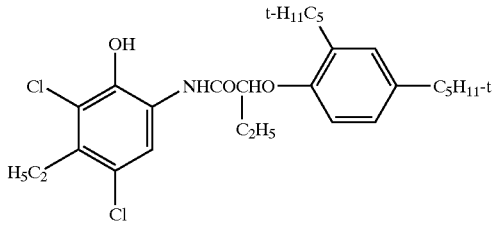

In blue-sensitized emulsions the following Spectral Sensitizing Dye B was used:

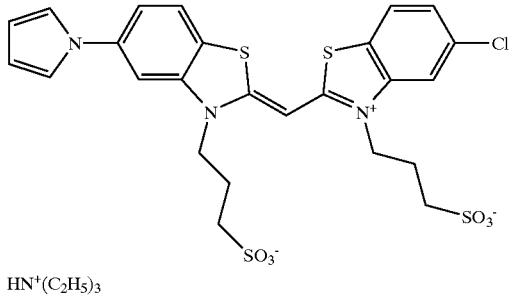

Just prior to coating on resin coated paper support blue-sensitized emulsions were dual-mixed with yellow dye forming Coupler B:

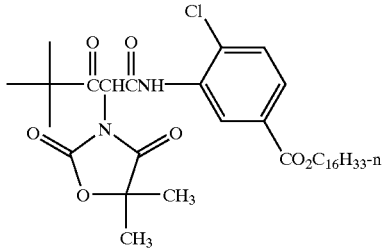

In green-sensitized emulsions the following Spectral Sensitizing Dye C was used:

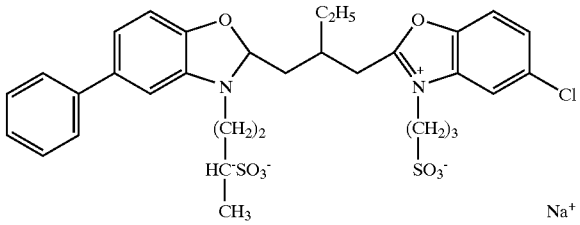

Just prior to coating on resin coated paper support green-sensitized emulsions were dual-mixed with magenta dye forming Coupler C:

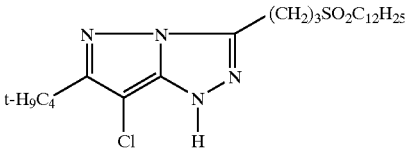

The red-sensitized emulsions were coated at 194 mg silver per square meter, blue-sensitized emulsions were coated at 280 mg silver per square meter while green-sensitized emulsions were coated at 108 mg silver per square meter on resin-coated paper support. The coatings were overcoated with gelatin layer and the entire coating was hardened with bis(vinlsulfonylmethyl)ether.

Photographic Comparisons

Coatings were exposed through a step wedge with 3000 K tungsten source at an exposure time of $10^{-2}$ second as well as at higher intensity, shorter exposure times of $10^{-3}$ to $10^{-5}$ second. The total energy of each exposure was kept at a constant level. Speed is reported as relative log speed (RLS) at specified level above the minimum density as presented in the following Examples. In relative log speed units a speed difference of 30, for example, is a difference of 0.30 log E, where E is exposure in lux-seconds. These exposures will be referred to as "Optical Sensitivity" in the following Examples.

Coatings were also exposed with Toshiba TOLD 9140™ exposure apparatus at 691 nm (red sensitized emulsions) or 532 nm (green sensitized emulsions), a resolution of 176.8 pixels/cm, a pixel pitch of 42.47 $\mu$m, and the exposure time of 1 microsecond per pixel. These exposures will be referred to as "Digital Sensitivity" in the following Examples.

All coatings were processed in Kodak™ Ektacolor RA-4. Relative optical speeds were reported at Dmin+1.8 or Dmin+2.2 density levels. Relative laser speeds were reported at Dmin+2.4 density level. Optical and laser contrast was measured between Dmin+0.2 and Dmin+1.8.

EXAMPLE 1

This example compares effects of iridium position on sensitivity, contrast and shoulder reciprocity failure. In each case, silver chloride cubic emulsions sensitized for red color record were used. The sensitization details are as follows:

Part 1.1: A portion of silver chloride Emulsion A was melted at 40° C. and then optimally sensitized by the addition of p-glutaramidophenyl disulfide (GDPD) followed by addition of the optimum amount of hypo followed by addition of gold(I). The emulsion was then heated to 65° C. and held at this temperature for 30 minutes with subsequent addition of 1-(3-acetamidophenyl)-5-mercaptotetrazole followed by addition of Lippmann bromide. Then the emulsion was cooled to 40° C. and Spectral Sensitizing Dye A was added.

Part 1.2: A portion of silver chloride Emulsion A was melted at 40° C. and then optimally sensitized by the addition of p-glutaramidophenyl disulfide (GDPD) followed by addition of Lippmann bromide followed by addition of the optimum amount of hypo followed by addition of gold(I). The emulsion was then heated to 65° C. and held at this temperature for 30 minutes with subsequent addition of 1-(3-acetamidophenyl)-5-mercaptotetrazole. Then the emulsion was cooled to 40° C. and Spectral Sensitizing Dye A was added.

Part 1.3: A portion of silver chloride Emulsion A was treated exactly as in Part 1.1 except that Lippmann bromide was doped with iridium.

Part 1.4: A portion of silver chloride Emulsion A was treated exactly as in Part 1.2 except that Lippmann bromide was doped with iridium.

Sensitometric data are summarized in Table I.

TABLE I

| | | | Optical Sensitivity | | | | | | Digital Sensitivity | |
|---|---|---|---|---|---|---|---|---|---|---|
| | | | Speed @ density D = 1.8 | | | Contrast from D = 0.2 to D = 1.8 | | | Speed @ density | Contrast from Dmin +0.2 to |
| Coating ID | $Ir^{+4}$ mg/mole Ag | $Ir^{+4}$ Position | $10^{-2}$s | $10^{-3}$s | $10^{-4}$s | $10^{-2}$s | $10^{-3}$s | $10^{-4}$s | D = 2.4 | Dmin +1.8 |
| Part 1.1 | — | — | 42 | 32 | 3 | 1.983 | 1.539 | 1.104 | 38 | 1.562 |
| Part 1.2 | — | — | 44 | 30 | 5 | 1.964 | 1.521 | 1.096 | 35 | 1.584 |
| Part 1.3 | 0.1 | After ChS | 57 | 46.5 | 18 | 2.001 | 1.687 | 1.286 | 42 | 1.677 |
| Part 1.4 | 0.1 | Before ChS | 59 | 48 | 45 | 1.928 | 1.895 | 1.862 | 82 | 2.359 |

(ChS = Chemical Sensitization)

Comparison of Parts 1.1 and 1.2 reveals that regardless of exposure time addition of bromide before or after the chemical sensitization in the absence of iridium does not exhibit a large effect on either contrast or shoulder speed reciprocity failure for the optical exposures, or shoulder speed or contrast for the digital exposures.

Comparison of Parts 1.3 and 1.4 reveals that addition of iridium doped silver bromide before the chemical sensitization exhibits both increase in sensitization and a large effect on contrast and shoulder speed reciprocity failure for the optical exposures relative to the addition after chemical sensitization. This effect is related to the exposure time; the shorter the exposure time the more significant contrast and shoulder improvements are observed when iridium is added before chemical sensitization. Addition of iridium doped silver bromide before the chemical sensitization also significantly improves contrast and shoulder speed for the digital exposures relative to addition after chemical sensitization.

EXAMPLE 2

This example compares effects of iridium position on sensitivity, contrast and shoulder reciprocity failure. In each case, silver chloride cubic emulsions sensitized for red color record were used. The sensitization details are as follows:

Part 2.1: A portion of silver chloride Emulsion A was optimally sensitized by the addition of GDPD followed by addition of a stilbene compound, followed by the optimum amount of hypo, followed by addition of gold(I). The emulsion was then heated to 65° C. and held at this temperature for 30 minutes with subsequent addition of 1-(3-acetamidophenyl)-5-mercaptotetrazole followed by addition of Lippmann bromide. Then the emulsion was cooled to 40° C. and Spectral Sensitizing Dye A was added.

Part 2.2: A portion of silver chloride Emulsion A was optimally sensitized by the addition of GDPD followed by addition of a stilbene compound, followed by addition of Lippmann silver bromide. The emulsion was then heated to 65° C. with subsequent addition of the optimum amount of hypo, followed by addition of gold(I), and subsequent addition of 1-(3-acetamidophenyl)-5-mercaptotetrazole. Then the emulsion was cooled to 40° C. and Spectral Sensitizing Dye A was added.

Part 2.3: A portion of silver chloride Emulsion A was treated exactly as in Part 2.1 except that Lippmann bromide was doped with iridium.

Part 2.4: A portion of silver chloride Emulsion A was treated exactly as in Part 2.2 except that Lippmann bromide was doped with iridium.

Sensitometric data are summarized in Table II.

TABLE II

| Coating ID | $Ir^{+4}$ mg/mole Ag | $Ir^{+4}$ Position | Optical Sensitivity: Speed @ density D = 1.8 $10^{-2}$s | $10^{-3}$s | $10^{-4}$s | Contrast from D = 0.2 to D = 1.8 $10^{-2}$s | $10^{-3}$s | $10^{-4}$s | Digital Sensitivity: Speed @ density D = 2.4 | Contrast from Dmin +0.2 to Dmin +1.8 |
|---|---|---|---|---|---|---|---|---|---|---|
| Part 2.1 | — | — | 40 | 22 | — | 2.114 | 1.512 | 1.196 | 27 | 1.385 |
| Part 2.2 | — | — | 42 | 28 | 6 | 2.124 | 1.418 | 1.201 | 30 | 1.404 |
| Part 2.3 | 0.1 | After ChS | 54 | 36 | 3 | 2.018 | 1.588 | 1.214 | 32 | 1.438 |
| Part 2.4 | 0.1 | Before ChS | 58 | 45 | 39 | 2.212 | 2.204 | 2.16 | 76 | 2.600 |

(ChS = Chemical Sensitization)

The presence of iridium in the finish significantly improves reciprocity characteristics. In this example the effect of the position of iridium addition in the cyan finish format in accordance with the invention is demonstrated. Addition of bromide alone before or after chemical sensitization does not impact reciprocity failure; however, addition of Lippmann bromide doped with iridium before chemical sensitization significantly improves high intensity reciprocity failure and contrast. The magnitude of the effect of iridium addition before chemical sensitization is time exposure dependent: the shorter the exposure time the more significant are the observed contrast and shoulder improvements when iridium is added before chemical sensitization. Addition of Lippmann bromide doped with iridium before chemical sensitization also significantly improves shoulder speed and contrast for the digital exposures.

EXAMPLE 3

This example compares effects of different iridium position on sensitivity, contrast and shoulder reciprocity failure. In each case, silver chloride cubic emulsions sensitized for blue color record were used. The sensitization details are as follows:

Part 3.1: A portion of silver chloride Emulsion B was optimally sensitized by addition of optimum amount of colloidal gold-sulfide followed by a heat ramp up to 60° C. for 20 minutes. Then Lippmann silver bromide was added followed by subsequent addition of Spectral sensitizing Dye B and 1-(3-acetamidophenyl)-5-mercaptotetrazole. Then the emulsion was cooled to 40° C.

Part 3.2: A portion of silver chloride Emulsion B was optimally sensitized by addition of Lippmann silver bromide followed by heating the emulsion to 60° C. and held at this temperature for 10 minutes followed by addition of an optimum amount of colloidal gold-sulfide. Then Spectral Sensitizing Dye B dye was added followed by subsequent addition of 1-(3-acetamidophenyl)-5-mercaptotetrazole. Then the emulsion was cooled to 40° C.

Part 3.3: A portion of silver chloride Emulsion B was treated exactly as in Part 3.1 except that Lippmann bromide was doped with iridium.

Part 3.4: A portion of silver chloride Emulsion B was treated exactly as in Part 3.2 except that Lippmann bromide was doped with iridium.

Sensitometric data are summarized in Table III.

TABLE III

| Coating ID | $Ir^{+4}$ mg/mole Ag | $Ir^{+4}$ Position | Optical Sensitivity: Speed @ density D = 1.8 $10^{-2}$s | $10^{-3}$s | $10^{-4}$s | Contrast from D = 0.2 to D = 1.8 $10^{-2}$s | $10^{-3}$s | $10^{-4}$s |
|---|---|---|---|---|---|---|---|---|
| Part 3.1 | — | — | 60 | 45 | 21 | 1.565 | 1.459 | 1.285 |
| Part 3.2 | — | — | 62 | 48 | 25 | 1.542 | 1.459 | 1.302 |
| Part 3.3 | 0.02 | After ChS | 58 | 48 | 42 | 1.771 | 1.764 | 1.714 |
| Part 3.4 | 0.02 | Before ChS | 68 | 67 | 66 | 1.914 | 2.312 | 2.512 |

The data clearly indicate that regardless of exposure time, addition of undoped Lippmann bromide before or after chemical sensitization does not result in an improvement or a degradation of contrast or shoulder speed reciprocity. However, the data clearly indicate that addition of iridium doped Lippmann bromide before chemical sensitization results in very substantial reduction of shoulder speed reciprocity failure for exposure times lower than $10^{-2}$ sec. The lower the exposure time the more substantial is the effect of iridium position in the finish on shoulder speed reciprocity and contrast. Addition of iridium before chemical sensitization improves contrast for all exposure times shown here.

EXAMPLE 4

This example compares effects of different iridium position on sensitivity, contrast and shoulder speed. In each case, silver chloride cubic emulsions sensitized for magenta color record were used. The sensitization details are as follows:

Part 4.1: A portion of silver chloride Emulsion C was optimally sensitized by addition of optimum amount of colloidal gold-sulfide followed by a heat ramp up to 60° C. and held at this temperature for 30 minutes. Then Lippmann silver bromide was added followed by subsequent addition of Spectral sensitizing Dye C and 1-(3-acetamidophenyl)-5-mercaptotetrazole. Then the emulsion was cooled to 40° C.

Part 4.2: A portion of silver chloride Emulsion C was optimally sensitized by addition of Lippmann silver bromide followed by addition of an optimum amount of gold-sulfide. Then emulsion was heated 60° C. and held at this temperature for 30 minutes followed by addition of an optimum amount of Spectral Sensitizing Dye C dye followed by subsequent addition of 1-(3-acetamidophenyl)-5-mercaptotetrazole. Then the emulsion was cooled to 40° C.

Part 4.3: A portion of silver chloride Emulsion C was treated exactly as in Part 4.1 except that Lippmann bromide was doped with iridium.

Part 4.4: A portion of silver chloride Emulsion C was treated exactly as in Part 4.2 except that Lippmann bromide was doped with iridium.

Sensitometric data are summarized in Table IV.

TABLE IV

| | | | Optical Sensitivity | | | | | | Digital Sensitivity | |
|---|---|---|---|---|---|---|---|---|---|---|
| | | | Speed @ density D = 1.8 | | | Contrast from D = 0.2 to D = 1.8 | | | Speed @ density | Contrast from Dmin +0.2 to |
| Coating ID | $Ir^{+4}$ mg/mole Ag | $Ir^{+4}$ Position | $10^{-2}$s | $10^{-3}$s | $10^{-4}$s | $10^{-2}$s | $10^{-3}$s | $10^{-4}$s | D = 2.4 | Dmin +1.8 |
| Part 4.1 | — | — | 134 | 124.4 | 108.6 | 1.597 | 1.507 | 1.389 | 8 | 1.338 |
| Part 4.2 | — | — | 135.2 | 126.4 | 109.4 | 1.582 | 1.501 | 1.392 | 9.5 | 1.326 |
| Part 4.3 | 0.1 | After ChS | 186.9 | 179.6 | 164.3 | 2.644 | 2.488 | 2.057 | 39 | 2.377 |
| Part 4.4 | 0.1 | Before ChS | 189.2 | 189.5 | 185.1 | 2.648 | 2.610 | 2.548 | 60 | 2.816 |

The data clearly indicate that regardless of exposure time, addition of undoped Lippmann bromide before or after chemical sensitization does not result in an improvement or a degradation of contrast or shoulder speed reciprocity failure. However, the data clearly indicate that addition of iridium doped Lippmann bromide before chemical sensitization results in very substantial improvement of both shoulder speed reciprocity and contrast for the optical exposures as well as sensitivity and contrast for the digital exposures. The magnitude of the effect of iridium addition before chemical sensitization is time exposure dependent: the shorter the exposure time the more significant are the observed contrast and shoulder improvements when iridium is added before chemical sensitization.

EXAMPLE 5

This example compares effects of iridium position on contrast and shoulder reciprocity failure. In each case, silver chloride cubic emulsions sensitized for red color record were used. The sensitization details are as follows:

Part 5.1: A portion of silver chloride Emulsion A was melted at 40° C. and then sensitized by the addition of the optimum amount of gold(I) followed by addition of hypo. Then emulsion was heated to 65° C. and held at this temperature for 30 minutes with subsequent addition of 1-(3-acetamidophenyl)-5-mercaptotetrazole followed by addition of Lippmann bromide. Then the emulsion was cooled to 40° C. and Spectral Sensitizing Dye A was added.

Part 5.2: A portion of silver chloride Emulsion A was melted at 40° C. and then Lippmann bromide was added followed by a heat ramp to 65° C. Then an optimum amount of gold(I) was added followed by addition of hypo with subsequent addition of 1-(3-acetamidophenyl)-5-mercaptotetrazole. Then the emulsion was cooled to 40° C. and Spectral Sensitizing Dye A was added.

Part 5.3: A portion of silver chloride Emulsion A was treated exactly as in Part 5.1 except that Lippmann bromide was added together with iridium hexachloroiridate solution.

Part 5.4: A portion of silver chloride Emulsion A was treated exactly as in Part 5.2 except that Lippmann bromide was added together with iridium hexachloroiridate solution.

Sensitometric data are summarized in Table V.

TABLE V

| | | | Optical Sensitivity | | | | | | Digital Sensitivity | |
|---|---|---|---|---|---|---|---|---|---|---|
| | | | Speed @ density D = 1.8 | | | Contrast from D = 0.2 to D = 1.8 | | | Speed @ density | Contrast from Dmin +0.2 to |
| Coating ID | $Ir^{+4}$ mg/mole Ag | $Ir^{+4}$ Position | $10^{-2}$s | $10^{-3}$s | $10^{-4}$s | $10^{-2}$s | $10^{-3}$s | $10^{-4}$s | D = 2.4 | Dmin +1.8 |
| Part 5.1 | — | — | 95.7 | 75.8 | 55.1 | 1.981 | 1.550 | 1.311 | 45 | 1.298 |
| Part 5.2 | — | — | 91.1 | 69 | 48.3 | 1.946 | 1.551 | 1.305 | 44 | 1.285 |
| Part 5.3 | 0.1 | After ChS | 111.4 | 92.5 | 76.8 | 2.142 | 1.845 | 1.486 | 70 | 1.546 |
| Part 5.4 | 0.1 | Before ChS | 101.6 | 96.4 | 88.9 | 2.181 | 2.081 | 1.945 | 80 | 1.805 |

The data clearly indicate that regardless of exposure time, addition of undoped Lippmann bromide before or after chemical sensitization does not exhibit a large effect on either contrast or shoulder speed reciprocity failure. However, the data clearly indicate that addition of iridium doped Lippmann bromide before chemical sensitization results in very substantial improvement of both shoulder speed reciprocity and contrast for the optical exposures as well as sensitivity and contrast for the digital exposures. The magnitude of the effect of iridium addition before chemical sensitization is time exposure dependent: the shorter the exposure time the more significant are the observed contrast and shoulder improvements when iridium is added before chemical sensitization.

The invention has been described in detail with particular reference to preferred embodiments thereof, but it will be understood that variations and modifications can be effected within the spirit and scope of the invention.

What is claimed is:

1. A method of imaging comprising providing a photographic element comprising at least one high chloride silver halide emulsion layer, exposing said element utilizing a high intensity actinic radiation exposure for an exposure time of less than 1/100 second, and developing said element to produce a photographic image, wherein the high chloride silver halide emulsion layer is comprised of silver halide emulsion grains containing at least 90 mole percent chloride, based on silver, obtained by providing a high chloride host emulsion, bringing a Lippmann emulsion comprising primarily fine silver bromide grains doped with iridium into contact with said high chloride host emulsion, and subsequently chemically sensitizing the high chloride emulsion.

2. The method of claim 1 wherein the exposure time is less than or equal to $10^{-3}$ second.

3. The method of claim 1 wherein the exposure time is less than or equal to $10^{-4}$ second.

4. The method of claim 1, wherein the exposing step comprises subjecting the high chloride silver halide emulsion layer to actinic radiation of at least $10^{-4}$ ergs/cm$^2$ for up to 100$\mu$ seconds duration in a pixel-by-pixel mode.

5. The method of claim 4, wherein the pixels are exposed to actinic radiation of about $10^{-3}$ ergs/cm$^2$ to $10^{-2}$ ergs/cm$^2$.

6. The method of claim 4, wherein the exposure is up to 10$\mu$ seconds.

7. The method of claim 4, wherein the duration of the exposure is up to 0.5$\mu$ seconds.

8. The method of claim 4, wherein the duration of the exposure is up to 0.05$\mu$ seconds.

9. The method of claim 4, wherein the source of actinic radiation is a light emitting diode.

10. The method of claim 4, wherein the source of actinic radiation is a laser.

11. The method of claim 4, wherein the recording element contains a yellow, magenta or cyan dye-forming coupler and is exposed to a portion of the infrared region of the spectrum by a laser source to produce a dye image on processing.

12. The method of claim 1 wherein said iridium is present in an amount of 0.005 mg/silver mole to 5.0 mg/silver mole.

13. The method of claim 1 wherein the high chloride emulsion comprises cubic grains having an average grain size of 0.15 microns to 1.5 microns in cubic edge length.

14. The method of claim 1 wherein said Lippmann emulsion has an average grain size of 0.02 microns to 0.08 microns in linear dimension.

15. The method of claim 1 wherein said Lippmann emulsion is added to the high chloride emulsion at a pH below 6.5.

16. The method of claim 1 wherein said Lippmann emulsion is added to the host emulsion in an amount sufficient to provide between about 0.05 and 3.0 mole percent bromide, based on total silver.

* * * * *